US005795040A

United States Patent [19]

Simmons

[11] Patent Number: 5,795,040

[45] Date of Patent: Aug. 18, 1998

[54] HANGING FILE HOLDER SUPPORT DEVICE

[76] Inventor: Mary C. Simmons, 5637 N. Key, Sebring, Fla. 33872

[21] Appl. No.: 756,457

[22] Filed: Nov. 26, 1996

[51] Int. Cl.[6] ..... A47B 63/00

[52] U.S. Cl. ..... 312/184; 312/330.1; 312/183; 211/46; 211/182

[58] Field of Search ..... 312/183, 184, 312/330.1, 194, 195, 238, 239, 257.1; D6/422, 509, 510; 211/182, 189, 46, 162

[56] References Cited

U.S. PATENT DOCUMENTS

| | | | |
|---|---|---|---|
| 1,355,033 | 10/1920 | Cheape | 211/182 X |
| 2,386,092 | 10/1945 | Cornish | 312/239 X |
| 2,533,155 | 12/1950 | Von Hacht | 312/194 |
| 3,683,581 | 8/1972 | Yamaso | 52/666 |
| 3,944,080 | 3/1976 | Hansen | 211/46 |
| 4,080,022 | 3/1978 | Canfield et al. | 312/239 |
| 4,632,259 | 12/1986 | Cameron | 211/119 X |
| 5,060,808 | 10/1991 | Engman | 211/189 X |
| 5,071,014 | 12/1991 | Robinson | 211/162 X |
| 5,393,136 | 2/1995 | Grabowski et al. | 312/184 |
| 5,405,020 | 4/1995 | Fotioo | 312/184 X |
| 5,499,481 | 3/1996 | Targetti | 211/189 X |
| 5,615,936 | 4/1997 | Simmons et al. | 312/330.1 X |

FOREIGN PATENT DOCUMENTS

| | | | |
|---|---|---|---|
| 512502 | 5/1955 | Canada | 312/194 |
| 729462 | 3/1966 | Canada | 312/184 |
| 2262770 | 9/1975 | France | 211/182 |
| 652472 | 2/1963 | Italy | 312/184 |
| 1761 | 5/1902 | United Kingdom | 312/195 |
| 591288 | 8/1947 | United Kingdom | 312/194 |
| 2169492 | 7/1986 | United Kingdom | 312/238 |

OTHER PUBLICATIONS

Popular Science "Kitchen Corner", Oct. 1954, p. 118.

*Primary Examiner*—Peter M. Cuomo
*Assistant Examiner*—James O. Hansen
*Attorney, Agent, or Firm*—Charles J. Prescott

[57] ABSTRACT

A hanging file folder support device, either free standing within, or as a connected part of, an annular drawer having a generally flat upright facing panel, upright parallel side panels, an upright back and a horizontal bottom panel. When viewed from above, these drawer components define a parallelogram having included acute angles. The device includes two spaced apart generally parallel hanging file folder support rails each having orthogonally oriented aligned portions forming a zigzag pattern along the length thereof when viewed from above. These support rails are either attached to the drawer side panels or are preferably free standing within the drawer either by two parallel cross frames each connected between each end of the support rails or as defined by upper margins of the sides of a frame such as that of molded thin-wall plastic and the like. In each embodiment, opposing alternate zigzag portions of the support rails are parallel to one another and perpendicular to the cross frames and spaced apart to supportively receive hanger tabs at upper corners of each hanging file folder.

7 Claims, 2 Drawing Sheets

HANGING FILE HOLDER SUPPORT DEVICE

BACKGROUND OF THE INVENTION

1. Scope of Invention

This invention relates generally to drawers and like units, and more particularly to a hanging file folder support device for and as a part of an angular drawer having a parallelogram form when viewed from above.

2. PRIOR ART

Applicant is aware of numerous work stations and desk modules oriented for corner use as follows:

Ball U.S. Pat. No. 4,323,291

Heck U.S. Pat. No. 4,345,803

Yeh U.S. Pat. No. 4,768,845

Bears U.S. Pat. No. 3,346,311

Ball U.S. Pat. No. 4,343,291

Waibel U.S. Pat. No. 4,559,877

Upon examination of these prior art units, none provide a drawer arrangement which, when withdrawn or opened, does not interfere with the user positioned at the work station. Those units which include drawers are of a conventional nature wherein each drawer moves linearly orthogonally with respect to the mating front surfaces of the work station or desk and drawer front panel. To applicants' knowledge, no enclosure provides such an angularly oriented drawer with linear movement about an angular orientation to the front surface of the unit drawer except as disclosed in U.S. patent application Ser. No. 08/562,526, filed Nov. 27, 1995 which is ready for issue invented by D. Simmons. Applicant is also aware of U.S. Pat. No. 4,080,022 issued to Canfield, et al for a Multiple Station Service Counter and an article in Popular Science, "Kitchen Corner", Oct. 1954, pg. 118.

Although the invention disclosed by D. Simmons has been well received in the marketplace, a significant problem has arisen with respect to the storage of hanging file folders in such angular drawers. Simply attaching a conventional free standing frame with parallel spaced straight support rails which supportively engage the hanging tabs at each upper corner of these file folders has proved to be problematic. The hanging file folders being oriented at an acute angle to the straight support rails has resulted in many of the file folders falling from improper engagement with the support rails. An attempt has been made to bend the metal strips attached at the upper margins of each of the file folders so that the end tabs are oriented orthogonally to the side rails with the file folders themselves remaining angularly oriented to the side rails. However, this has failed as well with many of the hanging file folders dropping from engagement as they are moved back and forth along the side rails.

The present invention provides, in one embodiment, an angular drawer having angularly oriented side panels with respect to its front facing panel and having spaced, parallel zigzag configured support rails attached along the upper margins of the side panels. In the preferred embodiment, the device is free standing for insertion into the angular drawer resting atop the bottom panel of the angular drawer and provides support rails having a similar zigzag configuration when viewed from above. Yet another embodiment may be a plastic molded thin upright wall frame structure with our without a bottom. By this arrangement, opposing segments of each side rail provide short segments which are parallel and spaced apart so that the hanging file folders are oriented orthogonally thereto when hung therefrom.

BRIEF SUMMARY OF THE INVENTION

This invention is directed to a hanging file folder support device, either free standing within, or as a connected part of, an annular drawer having a generally flat upright facing panel, upright parallel side panels, an upright back and a horizontal bottom panel. When viewed from above, these drawer components define a parallelogram having included acute angles. The device includes two spaced apart generally parallel hanging file folder support rails each having orthogonally oriented aligned portions forming a zigzag pattern along the length thereof when viewed from above. These support rails are either attached to the drawer side panels or are preferably free standing within the drawer either by two parallel cross frames each connected between each end of the support rails or as defined by upper margins of the sides of a frame such as that of molded thin-wall plastic and the like. In each embodiment, opposing alternate zigzag portions of the support rails are parallel to one another and perpendicular to the cross frames and spaced apart to supportively receive hanger tabs at upper corners of each hanging file folder.

It is therefore an object of this invention to provide an angular drawer which moves into and out of an enclosure such as a desk or corner work station at an acute angle with respect to the front upright surface of the enclosure and which securely receives and supports hanging file folders.

It is another object of this invention to provide a hanging file folder support device which is free standing for supportive positioning within an angular drawer having the shape of a parallelogram when viewed from above.

It is yet another object of this invention to provide a hanging file folder support device for an angular drawer having a parallelogram configuration when viewed from above, the device being adapted for orienting hanging file folders either parallel to the front facing or the side panels of the drawer.

In accordance with these and other objects which will become apparent hereinafter, the instant invention will now be described with reference to the accompanying drawings.

DETAILED DESCRIPTION OF THE INVENTION

Figure 1:
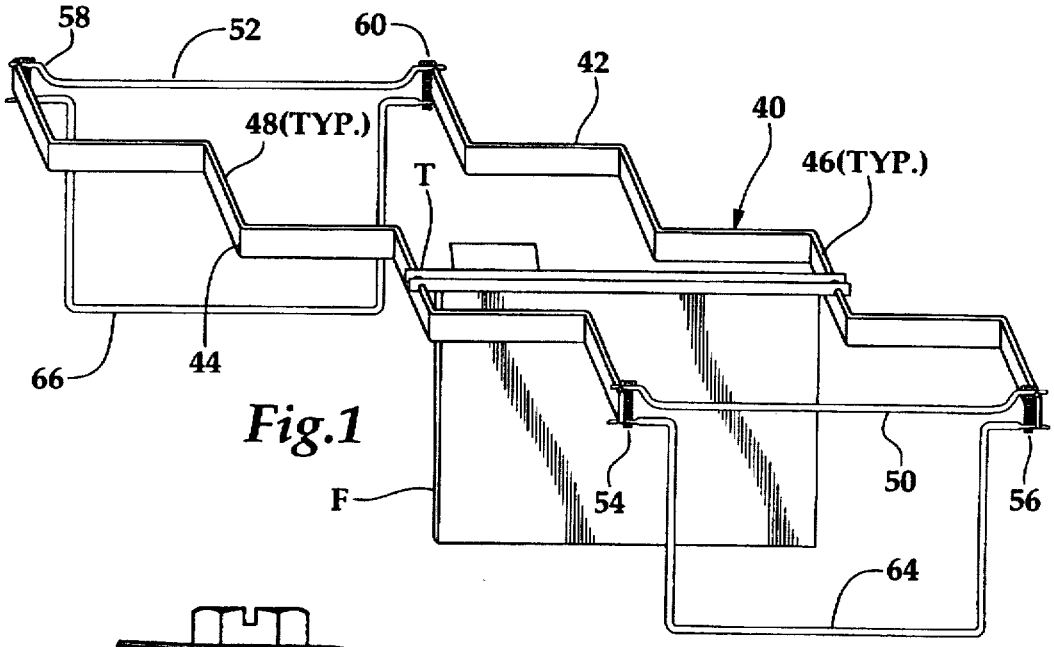
FIG. 1 perspective view of the preferred embodiment of the invention.
Figure 4:
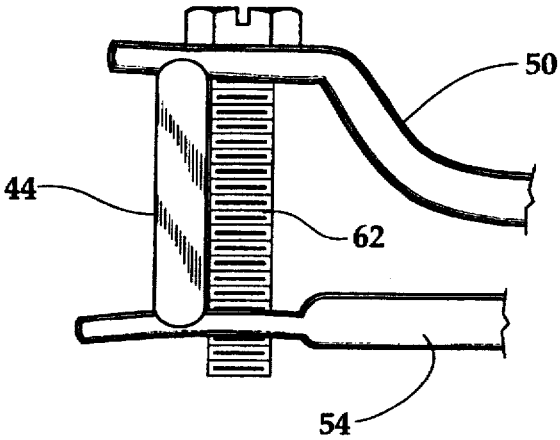
FIG. 4 is an enlarged view of an end connection at 54 in FIG. 1

Referring now to the drawings, and firstly to FIGS. 1 and 4, the preferred embodiment of the invention is shown generally at numeral 40. This free standing hanging file folder support device 40 includes two spaced apart substantially identical hanging file folder support rails 42 and 44 which are preferably formed of flat metal (aluminum) bar stock of suitable strength and thickness. Each of these support rails 42 and 44 includes a plurality of substantially orthogonally oriented zigzag portions or segments shown typically at 46 and 48, respectively. These zigzag portions extend along substantially the entire length of each of the support rails 42 and 44. The upper edge margins of each of these support rails 42 and 44 are substantially straight and coplanar.

The support rails 42 and 44 are connected and supported at each end thereof by elongated cross frames 50 and 52 the connection shown typically at 54 in FIG. 4. The end attachment structure between each end of each support rail 42 and 44 is effected by clamping engagement between each end of the cross frame 50 and each end of the cross members 50 and 52 and that of U-shaped support bars 64 and 66. A threaded fastener 62 squeezably maintains each of these relationships by maintaining clamping engagement of the edges of each end of each support rail 42 and 44 in mating grooves as shown.

This embodiment 40 is free standing so that each lower horizontal leg of each U-shaped support frame 64 and 66 rests atop an inside bottom panel of an angular drawer described herebelow. By properly selecting the length of the upright legs of each support member 64 and 66, a typical hanging file folder F may be supportively hung on hanger tabs T located at each upper corner of each panel of the file folder F. These hanging tabs T include notches which are downwardly facing and sized to slidably engage over the upper edge of each of the support rails 42 and 44. In this zigzag configuration of each of the support rails 42 and 44, alternate aligned portions 46 and 48 are orthogonally oriented to cross frames 50 and 52 and are spaced apart so as to supportively engage the hanging tabs T at each end of the file folder F as shown in FIG. 1.

Figure 2:
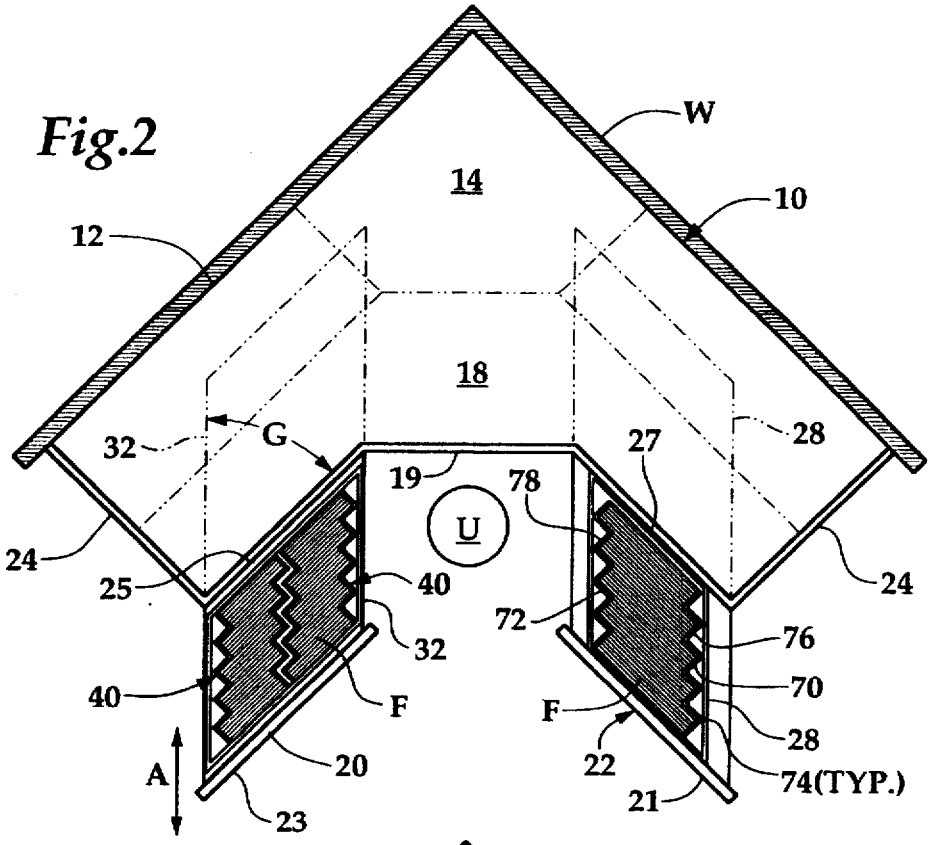
FIG. 2 is a top plan view of a corner work station having angular drawers and showing each embodiment of the invention adapted for hanging file folder orientation parallel to a front facing panel of each drawer.
Figure 3:
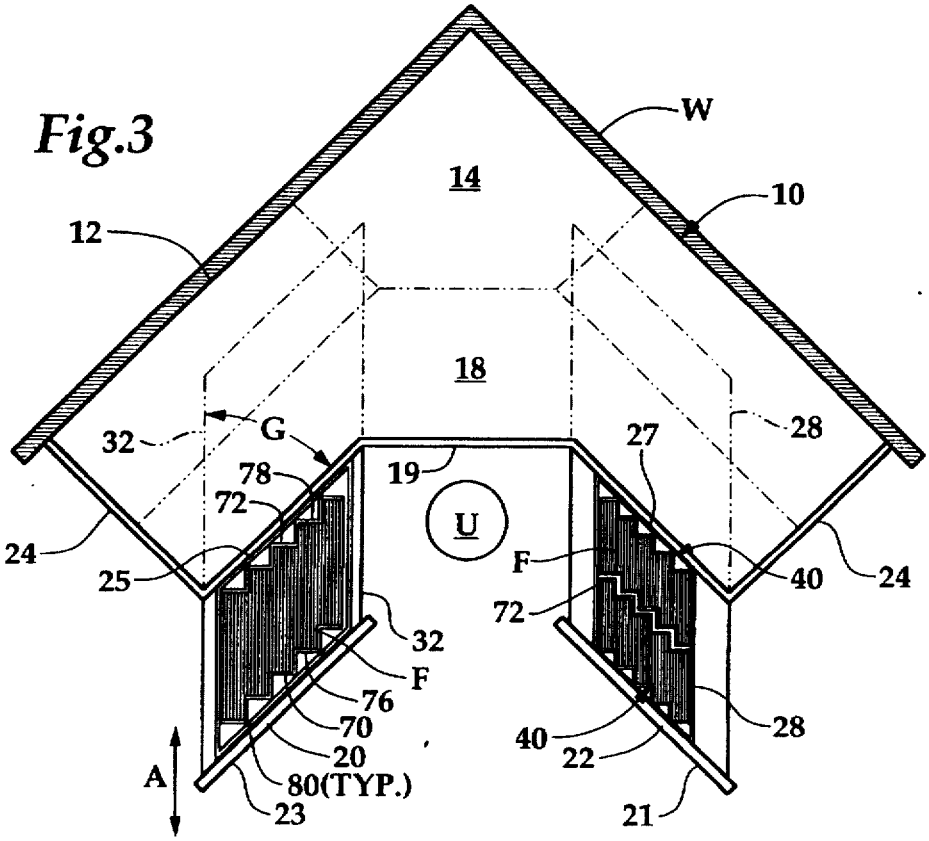
FIG. 3 is a view similar to FIG. 2 showing each embodiment of the invention adapted for hanging file folder orientation parallel to the side panels of each angular drawer.

Referring now to FIGS. 2 and 3, a corner work station shown generally at numeral 10 is structured to fit against the orthogonal walls W and includes a desk 12 having a horizontal working surface 18 supported by connected upright generally flat desk panels of the desk 12 as shown to define an enclosure below the working surface 18. A user is typically positioned at circle U facing a front margin 19 of the working surface 18. Office equipment such as a computer and monitor may be positioned atop the work surface 18 or enclosed within a tower 14 as shown.

The majority of such corner work stations 10 are structured so that the front facing margin or surface 19 is oriented at an acute angle to each wall W of 450 for symmetry. Side doors 24 and the associated supporting structure of the desk 12 are thus oriented orthogonally with respect to the corresponding wall W as shown for aesthetic continuity.

The working station 10 also includes angular drawers 20 and 22 each having front facing panels 21 and 23, respectively, which conceal similarly sized rectangular front openings formed into the corresponding angled front surfaces of the desk 12. Each drawer 20 and 22 includes an upright back panel, which is parallel to its facing panel 21 and 23, and a horizontal bottom panel.

Each of the angular drawers 20 and 22 are supported on well-known spaced apart two-part glides 26 and 30, respectively. These glides 26 and 30 are typically structured having two elongated elements held together by rollers, the outer element being connected to two spaced upright desk panels of the desk unit 12 while the inner movable portions of the glides 26 and 30 are connected to upright side panels 28 and 32 (typ.) of each angular drawer 20 and 22 as shown.

Each of the angular drawers 20 and 22 is structured having these parallel side panels 28 and 32 (typ.) oriented at an acute angle of G in FIG. 2 with respect to the front openings of the desk 12 and the upright drawer facing panels 21 and 23. This angle G is preferably about 45° and may be in the range of about 30° to 60°, depending upon the angular configuration of the corner walls W or as desired.

By this arrangement, the angular drawers 20 and 22 may be withdrawn and closed in the direction of arrows A in a linear movement which is oriented at an acute angle G with respect to both the walls W and the front openings of desk 12. Thus, a user positioned at circle U at work may thus remain in that position while having full access to the contents of each of the drawers 20 and 22 without interfering with drawer movement.

The preferred invention embodiment 40 of FIG. 1 is shown positioned in duplicate within drawer 20. Being free standing, two of the devices 40 will nest within drawer 20 supported atop its bottom panel as shown. By this arrangement, the file folders F supported on its support rails 42 and 44 are oriented parallel to the facing plate 23.

Still referring to FIG. 2, an alternate embodiment of the invention is shown positioned and permanently attached within angular drawer 22. This embodiment includes two zigzag configured support rails 70 and 72 formed in a fashion similar to support rails 42 and 44 of FIG. 1. However, these support rails 70 and 72 or attached at 74 (typ.) by mechanical fasteners and the like along the upper margins of the side panels 28 (typ.) of angular drawer 22. Thus, the need for the cross frames 50 and 52 of embodiment 40 are unnecessary in that the support rails 70 and 72 are permanently attached by fasteners at 74 (typ.). Again, in this arrangement in FIG. 2, the hanging file folders F are hung between parallel segments 76 and 78 so as to be parallel to the front facing panel 22.

In FIG. 3, each of the embodiments described in FIGS. 1 and 2 are shown adapted and positioned so that the hanging file folders F in each of the angular drawers 20 and 22 are oriented generally parallel to the side panels 28 and 32 (typ.). In drawer 22, two of the support devices 40 are again nestled together side by side atop the bottom panel of the drawer 22. Within angular drawer 20, the independent support rails 70 and 72 have been connected by fasteners at 80 (typ.) along the upper margins of the facing panel 23 and the back panel 25 at a height just slightly larger than the hanging length of each of the hanging file folders F so as to hold the lower margins of the file folders F just above the bottom panel of each drawer 20 and 22.

Figure 5:
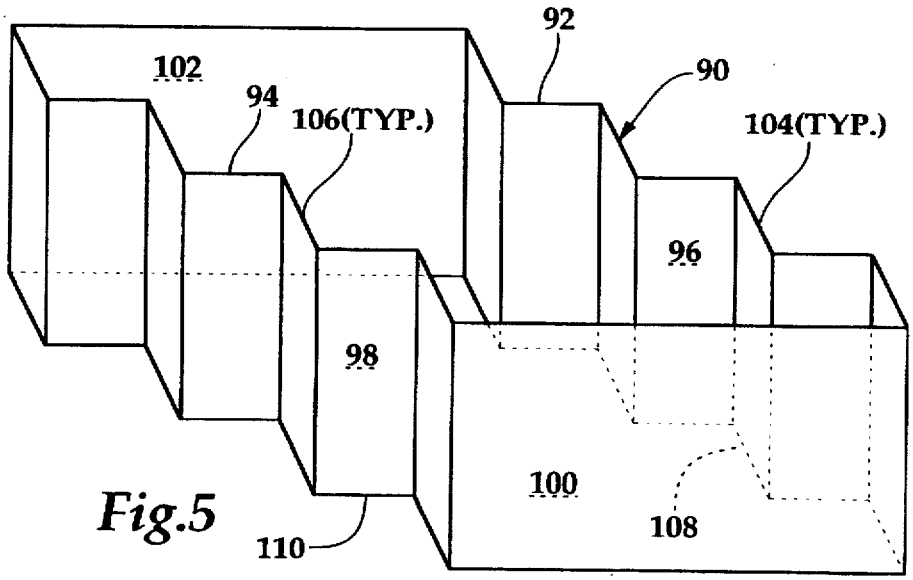
FIG. 5 is a perspective view of another embodiment of the invention.

Referring lastly to FIG. 5, another embodiment of the invention is there shown generally at numeral 90. This embodiment 90 is mold formed of thin-wall plastic material having upright side walls 96 and 98 which define an open upper end of the frame 90 and upper margins or support rails 92 and 94. These support rails 92 and 94 are coplanar and are structured similar to the previous embodiments, each support rail 92 and 94 having orthogonally oriented zig-zag portions extending end-to-end along substantially the entire length of each of these side rails 92 and 94.

End panels 100 and 102 are sized in length so as to position alternate aligned parallel zigzag portions 104 and 106 (typ.) a distance apart generally equal to that of the previously described notches in hanging tabs T of FIG. 1. The height of the frame 90 resting on lower margins 108 and 110 is established to be slightly greater than the downward hanging length of each file folder F so that a low margin of each file folder F is spaced just above the bottom panel of the drawer into which the frame 90 is positioned.

The device may include a bottom panel or be opened for economy of material and weight savings. In either embodiment, the lower the margins 108 and 110 rest atop the bottom panel of the drawer.

While the instant invention has been shown and described herein in what are conceived to be the most practical and preffered embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. For an angular drawer, a hanging file folder support device positionable for use within the drawer which has a generally flat upright facing panel, upright parallel drawer side panels, an upright back and a horizontal bottom panel, the facing panel, drawer side panels and the back, when viewed from above, defining a parallelogram having included acute angles, said support device comprising:

two substantially identical hanging file folder upper support rails held spaced apart by an elongated slender cross frame disposed between each corresponding ends of said support rails, said support rails defining substantially coplanar upper margins having a plurality of spaced pairs of substantially orthogonally oriented zigzag portions extending along said support rails as viewed from above, said upper margins being substantially coplanar, said support rails and said cross frames substantially defining a parallelogram similar to that of the drawer;

upright support members each connected at each upper end thereof to each end of said support rails, said upright support members capable of resting atop the drawer bottom panel for supporting said support rails above the drawer bottom panel whereby a hanging file folder may be supported between each pair of zigzag portions.

2. A hanging file folder support device as set forth in claim 1 wherein:

said support rails are configured in length and held spaced apart a distance such that said support rails extend along and in close proximity to the drawer side panels whereby hanging file folders are hung substantially parallel to the facing panel.

3. A hanging file folder support device as set forth in claim 1, wherein:

said support rails are configured in length and held spaced apart a distance such that said support rails extend along and in close proximity to the facing and back panels whereby hanging file folders are hung substantially parallel to the drawer side panels.

4. In combination, an angular drawer and a hanging file folder support device comprising:

said angular drawer including an upright flat facing panel, upright spaced parallel drawer side panels, an upright back panel and a horizontal bottom panel, said drawer side panels being oriented at an acute angle with respect to said facing panel when viewed from above, defining an overall shape of a parallelogram with included acute angles;

said support device including two file folder support rails each having a generally zigzag configuration when viewed from above formed by a plurality of substantially orthogonally oriented straight portions extending along a length of each said support rail;

one said support rail connected along an upper portion of each said side panel or said facing and back panels, respectively, corresponding alternate straight portions of each said support rail being opposingly spaced and substantially parallel whereby hanging file folders may be hung therefrom.

5. For an angular drawer, a hanging file folder support device positionable for use within the drawer which has a generally flat upright facing panel, upright parallel drawer side panels, an upright back and a horizontal bottom panel, the facing panel, drawer side panels and the back, when viewed from above, defining a parallelogram having included acute angles, said support device comprising:

a frame having spaced apart, thin upright side panels each having substantially coplanar upper and lower margins, said upper margins defining spaced apart substantially identical hanging file folder support rails each having a plurality of substantially straight and orthogonally oriented zigzag portions along a length thereof as viewed from above;

said upright frame also including two substantially parallel end panels each extending between corresponding ends of said frame side panels, said lower margins capable of resting atop the bottom panel when said support device is placed within the drawer whereby hanging file folders may be suspended from and between corresponding said zigzag portions.

6. A hanging file folder support device as set forth in claim 5, wherein:

said support rails are configured in length and held spaced apart by said frame sides a distance such that said support rails extend along and in close proximity to the drawer side panels whereby hanging file folders are hung substantially parallel to the facing panel.

7. A hanging file folder support device as set forth in claim 5, wherein:

said support rails are configured in length and held spaced apart by said frame ends a distance such that said support rails extend along and in close proximity to the facing and back panels whereby hanging file folders are hung substantially parallel to the drawer side panels.

* * * * *